United States Patent [19]

Licciardi

[11] Patent Number: 4,503,845

[45] Date of Patent: Mar. 12, 1985

[54] APPARATUS FOR SUPPORTING A USER IN AN INVERTED POSITION

[75] Inventor: Anthony L. Licciardi, Boulder City, Nev.

[73] Assignee: Back-Ease Products, Inc., Rochester, N.Y.

[21] Appl. No.: 331,613

[22] Filed: Dec. 17, 1981

[51] Int. Cl.[3] ..... A61H 1/02; A63B 1/02

[52] U.S. Cl. ..... 128/75; 272/63; 272/145

[58] Field of Search ..... 272/62, 63, 144, 145, 272/93, 134, 61; 128/75, 25 R, 68, 71

[56] References Cited

U.S. PATENT DOCUMENTS

| | | | |
|---|---|---|---|
| Re. 31,092 | 11/1982 | Sieber | 272/144 |
| D. 191,690 | 10/1961 | Ryan | 272/144 |
| 860,517 | 7/1907 | Berglund | 272/63 |
| 2,932,510 | 4/1960 | Kravitz | 272/62 |
| 3,006,643 | 10/1961 | Ryan | 272/144 |
| 3,593,708 | 7/1971 | Steele | 272/61 |
| 3,874,375 | 4/1975 | Penner | 272/63 X |
| 4,077,403 | 3/1978 | Steele | 272/62 |
| 4,337,942 | 7/1982 | Sidlinger | 272/144 |
| 4,341,378 | 7/1982 | Agyagos | 272/144 |
| 4,461,287 | 7/1984 | Takahashi | 128/75 |

FOREIGN PATENT DOCUMENTS

| | | | |
|---|---|---|---|
| 904366 | 7/1972 | Canada | 272/144 |
| 1365542 | 9/1974 | United Kingdom | 128/75 |

OTHER PUBLICATIONS

Washington Post—p. E1, 2/18/1972.

*Primary Examiner*—Richard J. Johnson
*Attorney, Agent, or Firm*—Cumpston & Shaw

[57] ABSTRACT

Apparatus for supporting a user in an inverted position is described. A pair of triangular bases supporting a vertical member. A horizontal thigh support member with pivotable pads thereon and a horizontal foot support member vertically spaced apart from said thigh support member, are disposed between the vertical members.

9 Claims, 7 Drawing Figures

APPARATUS FOR SUPPORTING A USER IN AN INVERTED POSITION

This invention relates in general to exercise and body support apparatus and more particularly to apparatus for supporting a user in a generally inverted position.

Various devices have been used in the past to support a user in an inverted position to achieve the therapeutic benefits thereof. These devices have spanned a range of complexities from relatively simple devices for allowing a person to hang suspended by his feet or ankles as exemplified by U.S. Pat. No. 3,380,447 to more complex devices exemplified by U.S. Pat. No. 3,593,708 which include a multiplicity of elements such as straps and cables and the like. These and other similar devices have suffered from certain disadvantages which have made their use difficult. Some, for example a device described in U.S. Pat. No. 3,716,231, have required external structures for supporting them such as would be supplied by mounting rigidly between the floor and ceiling of a room or in a door frame or the like. Others have been somewhat difficult and therefore expensive to manufacture and therefore not so readily available for widespread use.

A particular disadvantage of virtually all of the apparatus of the type to which this invention is addressed has been that they are not readily used without assistance in mounting and dismounting. While in some cases a particularly athletic user could in fact mount the apparatus unassisted, it has not been possible for more elderly or less physically adept users to obtain the advantages of inversion.

Accordingly, it is an object of this invention to provide apparatus for supporting the body in an inverted position which overcomes the disadvantages of such apparatus as have been heretofore known.

It is a particular object of this invention to provide apparatus for supporting a user in an inverted position which can be easily mounted by a user unassisted and without the necessity for great strength or agility.

It is yet another object of this invention to provide apparatus for supporting a user in an inverted position which securely supports the user during use and is easy to dismount.

It is still another object of this invention to provide apparatus for supporting a user in an inverted position which requires only a single relatively flat surface for support and which particularly does not require a door frame or ceiling support for use.

Briefly stated and in accordance with a presently preferred embodiment of the invention, an apparatus for supporting a user in an inverted position includes a horizontal thigh support member which preferably includes padded thigh support platforms mounted for rotation during mounting and dismounting to prevent rubbing or abrasion of the thighs with accompanying discomfort. A horizontal member is disposed above the thigh support member for bracing of the feet with the knees in a bent condition to provide secure support for the user. The apparatus further includes inclined members for grasping by the user during mounting and dismounting to make the mounting and dismounting operation as easy as possible and to assure maximum safety.

It is a feature of this invention that with the exception of the thigh support platforms, the entire apparatus may be conveniently constructed of rigid tubing in a configuration including triangular support members for use on a relatively flat surface without the need for further attachment to other horizontal or vertical surfaces.

It is another feature of this invention that inclined hand-graspable members may serve the additional function of providing a portion of the triangular support base.

In accordance with another feature of this invention, a further horizontal member may be provided between the inclined hand-graspable members for grasping by the hands especially during positioning of the feet against the horizontal foot support bar. In this way the body can be maintained in a relatively secure position supported by the thigh support pads and by the hands and arms while the legs are bent into position for bracing the feet against the foot support bar.

The features of the invention which are believed to be novel are set forth in the appended claims. Further advantages thereof may be more fully appreciated however by reference to the following description taken in connection with the accompanying drawing in which:

Figure 1:
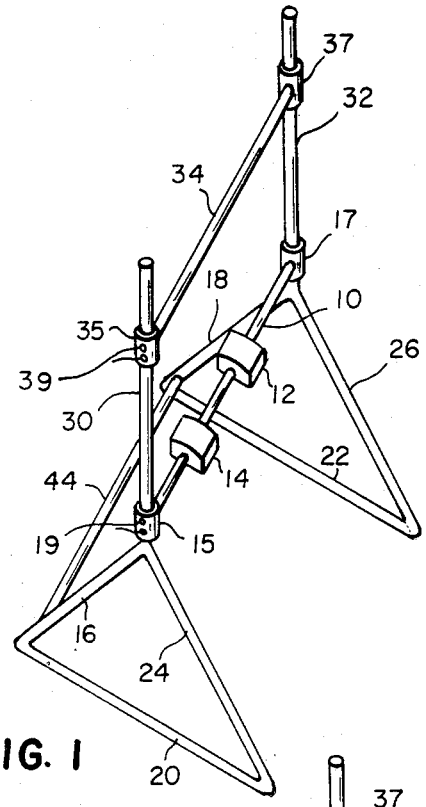
FIG. 1 is a perspective view of an apparatus for supporting a user in an inverted position in accordance with one embodiment of this invention.

Referring now to FIG. 1, an apparatus for supporting a user in an inverted position is illustrated including a generally horizontal thigh support bar 10 having first and second thigh support platforms 12 and 14 mounted thereto which platforms are preferably mounted on bar 10 to allow them to pivot about the axis of bar 10 during mounting, use and dismounting of the apparatus. It will be appreciated by those skilled in the art that this pivoting may also be accomplished if desired, by attaching platforms 12 and 14 in fixed relationship to bar 10 and allowing bar 10 to rotate with respect to the remainder of the apparatus through the use of end bearings or the like. It is preferred in accordance with this invention, that bar 10 be disposed a sufficient height above the surface upon which the apparatus is used to allow platforms 12 and 14 to support the thighs of the user during use of the apparatus at a height such that the head of the user is suspended above the floor a distance of between about an inch to several inches. It is likewise preferred that platforms 12 and 14 contact the thighs of the user as he stands prior to mounting the apparatus at a position which will not require the user to change the position of his thighs with respect to the thigh support platforms during use thereby to prevent rubbing or abrasion of the pads against the thighs of the user with the accompanying discomfort. Thigh support member 10 is supported above the surface on which the apparatus is placed by first and second triangular support structures which comprise bars 16, 18, 20, 22, 24 and 26. Preferably, and in accordance with this invention, these and the other elements of the structure are made of rigid tubing such as rigid plastic tubing, metal pipe, conduit or the like which are sufficiently strong when assembled into the apparatus depicted to support the weight of the user without undue deformation. The connection between the various members which make up the apparatus of this invention may be made in accordance with any of a number of methods well known to those skilled in the art. For example, where a metal tubing or pipe is employed the elements may be welded together or in the alternative, certain elements may be welded while others such as thigh support member 10 may be adjustably connected. Where plastic tubing is employed, adhesively connected joints may be employed.

First and second spaced apart vertical members 30 and 32 are provided which extend from the juncture of members 16 and 24 on the one end and 18 and 26 on the other end upward from thigh support bar 10 and to which is attached foot support member 34. The spacing between foot support member 34 and thigh support member 10 is preferably selected so that the knees may be comfortably bent while the user is in the inverted position and the soles of the feet braced against foot support member 34. Where desired, vertical members 30 and 32 may be made somewhat longer than shown with foot support member 34 adjustably attached thereto for permitting the spacing between thigh support member 10 and foot support member 34 to be easily adjusted to accommodate users of different sizes. Still further, thigh support member 10 itself may be adjustably mounted to vertical members 30 and 32 to allow it to be raised and lowered with respect to the surface on which the apparatus is used also to accommodate different sized users. The height of bars 10 and 34 are adjusted in accordance with a preferred embodiment of this invention by fixing bars 10 and 34 to end sleeves 15 and 17, and 35 and 37 which slidably engage vertical members 30 and 32 and may be anchored in fixed position thereto by set screws 19 on sleeve 15 and like set screws on sleeve 17 (not shown) as well as set screws 39 on sleeve 35.

In order to assist the user in positioning himself during mounting and dismounting, a further horizontal member 44 is preferably connected between the junctures of members 16 and 20 on one end and 18 and 22 on the other end, for grasping by the user during positioning of the feet against foot support member 34. To this end, it may be preferred to space member 44 a short distance above the surface on which the apparatus is used to provide a space beneath the bar to enable the user to grasp the bar easily with his hands. In the alternative, bar 44 may be provided with an upwardly bent portion in the center thereof so that the ends of bar 34 may be conveniently mounted at the aforesaid junctures while the center may be more easily grasped by the user. Those skilled in the art will recognize that other expedients such as the provision of a separate handle or the like for grasping by the user may be employed to the same effect.

Figure 2:
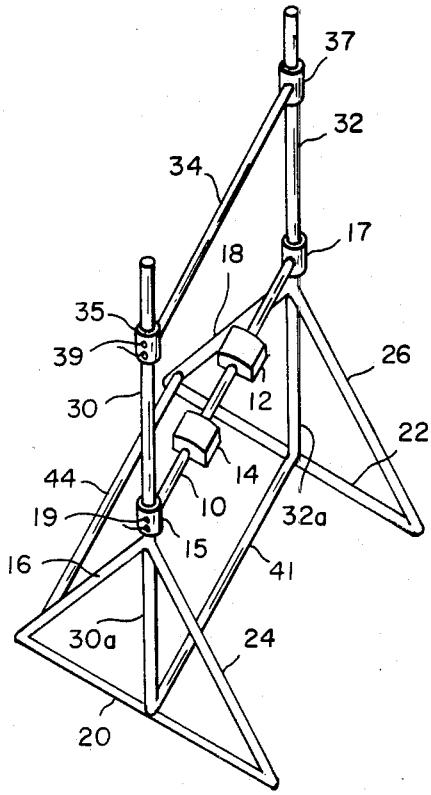
FIGS. 2 and 3 are perspective views of an apparatus for supporting a user in an inverted position in accordance with alternative embodiments of this invention.

An alternative embodiment of the invention is illustrated in FIG. 2 in which Figure and in the Figures to follow, like reference numerals are used to designate like elements of the invention. In FIG. 2, vertical members 30 and 32 are extended and are attached to horizontal members 20 and 22 respectively. By extending bars 30 and 32 which extensions are designated, 30*a* and 32*a* respectively in FIG. 2, the connection between the bar 30 and the juncture of elements 16, 24 and 10 need not be rigid to prevent relative movement thereof as was the case in FIG. 1. If desired, elements 24 and 26 of FIG. 2 may in fact be eliminated in that embodiment since the structure is rigid without them. The use of such elements may be desirable to allow lighter gauge tubing or pipe to be used and they in no way interfere with the use of the apparatus. In accordance with a preferred embodiment of this invention, lateral bottom bar 41 may be provided to even further enhance the strength and rigidity of the structure.

Figure 3:
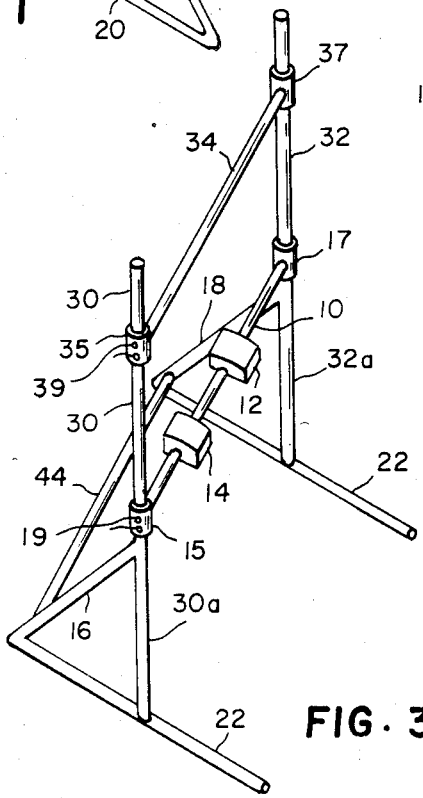
Figure 4:
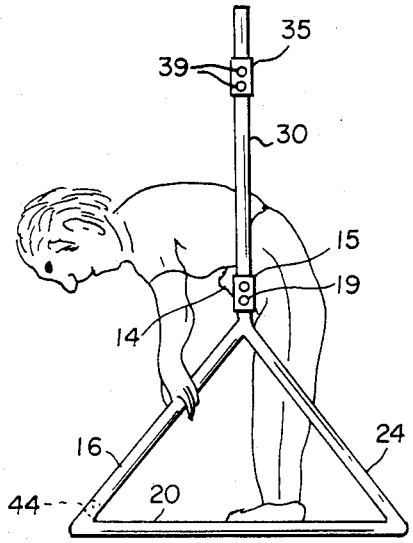
FIGS. 4 through 7 are views of the invention in accordance with the embodiment illustrated in FIG. 1 showing the method by which a user may mount, use and dismount the apparatus without assistance.

An embodiment of the invention wherein elements 24 and 26 are eliminated is shown in FIG. 3.

Figure 5:
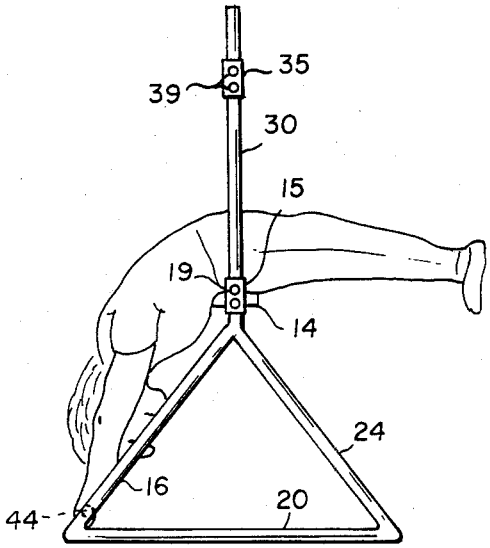
Figure 6:
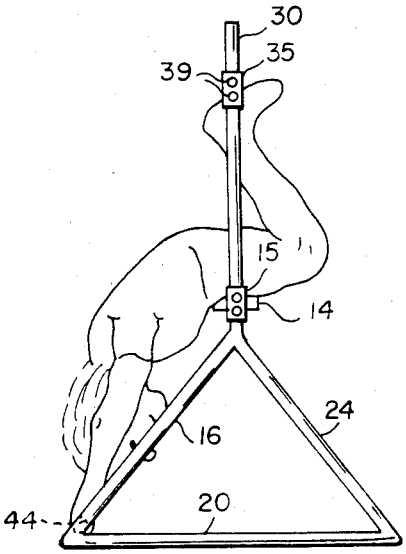
Figure 7:
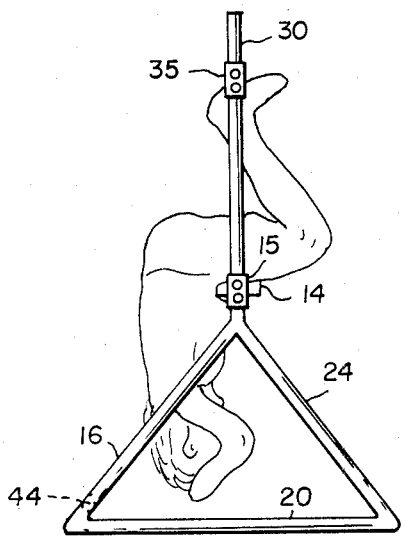

The manner of using the apparatus of this invention is illustrated in FIGS. 4 through 7. To mount, the user inserts his upper body through the space between thigh support bar 10 and foot support bar 34 and grasps inclined members 16 and 18 with his hands while keeping feet on the floor. It may be necessary for some users to stand on their toes in order to position the thighs comfortably against thigh support platforms 12 and 14. The body may then be pulled forward by the hands while simultaneously shifting the weight off the feet to enable the user to pivot about bar 10 and simultaneously move his hands down inclined members 16 and 18 thus raising the feet from the floor. As the thighs of the user reach a generally horizontal position, it will be possible for him to reach bar 44 and grasp it securely with his hands as shown in FIG. 5. At this point, the user may readily bend his knees and place the soles of his feet against foot support bar 34. This position with the thighs supported by thigh support 10 and the feet braced against bar 34 will allow the user to release his hands and hang comfortably in the inverted position without further support as shown in FIG. 7.

In order to dismount, the user essentially reverses the steps heretofore outlined. First by straightening the body slightly while maintaining the feet in the braced position against bar 10, the user is able to grasp bar 44. At this point he may safely remove his feet from bar 34 and straighten his legs to bring the feet and legs to a horizontally extended position. By shifting his hands outwardly along bar 34 he may securely grasp inclined members 16 and 18 and by simultaneously shifting his hands upwardly along bars 16 and 18 and shifting his weight towards his feet he may return to a position with his feet on the floor without the necessity for ever pivoting freely. After the feet are securely on the floor, the hands may be moved completely up bars 16 and 18 to shift the weight to the feet and allow the user to complete the dismounting of the apparatus.

While the invention has been described in accordance with certain presently preferred embodiments thereof, those skilled in the art will recognize that certain modifications and changes may be made thereto without departing from the true spirit and scope of the invention. For example, while it is desirable; and especially for male users, to provide separate thigh support platforms, single continuous platform may be usable in certain cases. Further, the thigh support platform itself may be eliminated by the expedient of providing a rotatable or nonrotatable padded bar which will function to support the user. Still further, the apparatus may be constructed from a number of well known materials which possess sufficient rigidity and strength to provide the structure heretofore described. Accordingly, it is intended that the invention be defined solely in terms of the appended claims.

What is claimed is:

1. Apparatus for supporting a user in an inverted position comprising:

a horizontal thigh support member supported above the floor a distance sufficient to enable the user to hang inverted with his thighs supported thereby, said thigh support member having at least one thigh support platform movable between a mounting position and a supporting position for permitting the user to maintain a fixed thigh position relative to the platform during mounting, use and dismounting of the apparatus thereby eliminating rubbing and discomfort;

a foot support member vertically spaced above and parallel to said thigh support member for bracing the feet of the user in a bent knee position thereby enabling the user to hang inverted without further support or restraint; and first and second inclined members each having first and second ends extending generally from near the ends of said thigh support member to the floor for grasping by the user during mounting to enable a user to safely mount the apparatus unassisted.

2. The apparatus of claim 1 wherein said thigh support member comprises at least one essentially flat thigh support platform pivotally mounted to a horizontally disposed bar for permitting the user to maintain a fixed thigh position relative to the platform during mounting, use and dismounting of the apparatus thereby eliminating rubbing and discomfort.

3. The apparatus of claim 1 wherein said thigh support member comprises at least one essentially flat thigh support platform fixedly mounted to a horizontally disposed rotatable member supported at one and another ends thereof by bearings for permitting the user to maintain a fixed thigh position relative to the platform during mounting, use and dismounting of the apparatus thereby eliminating rubbing and discomfort.

4. The apparatus of claim 1 further comprising first and second spaced apart vertical support members having said thigh support member and said foot support member attached thereto in vertically spaced apart relationship.

5. The apparatus of claim 4 wherein a first end of each of said first and second inclined members is attached to said first and second vertical support members respectively.

6. The apparatus of claim 5 further comprising a horizontal member disposed between said first and second inclined members respectively for grasping by the user during mounting and especially while positioning the feet on said second member.

7. The apparatus of claim 6 further comprising a second horizontal member attached between said vertical members and spaced below said horizontal thigh support member, and first and second bracing members attached between the junctures of said vertical members and said second horizontal member at first ends thereof and the second ends of said inclined member and forming a generally triangular rigid support for the apparatus.

8. Apparatus for supporting a user in an inverted position for use on a generally flat surface and which is mountable by the user unassisted comprising:

first and second spaced apart vertical members;

a first horizontally disposed rotatable thigh support means mounted between said vertical members for engaging the thighs of the user as he stands erect and for maintaining a fixed position relative to the thighs during mounting, use and dismounting;

a first horizontally disposed foot support member mounted between said vertical members and spaced above said thigh support member for receiving the feet of the user with the soles thereof positioned generally against the lower surface of said member;

first and second inclined hand support members attached at one ends thereof to said first and second spaced apart vertical members and having the opposite ends thereof lower than said one ends for grasping by the user during mounting and dismounting of the apparatus to enable the user to accomplish the same unassisted.

9. The apparatus of claim 8 further comprising means including said inclined hand support members forming first and second triangular support frames attached to said first and second vertical members respectively for supporting said apparatus on said surface.

* * * * *